US010711542B2

(12) United States Patent
Wright et al.

(10) Patent No.: US 10,711,542 B2
(45) Date of Patent: Jul. 14, 2020

(54) CIRCUMFERENTIAL DISPLACEMENT SUCKER ROD TONG

(71) Applicant: Automated Rig Technologies Ltd., Calgary (CA)

(72) Inventors: Monte Neil Wright, Calgary (CA); Donald Nicholas Carmelo, Calgary (CA); Andrew David Richard, Calgary (CA); Harold James Miller, Calgary (CA); David Luis Richard, Calgary (CA)

(73) Assignee: Automated Rig Technologies Ltd, Calgary, Alberta (CA)

( * ) Notice: Subject to any disclaimer, the term of this patent is extended or adjusted under 35 U.S.C. 154(b) by 708 days.

(21) Appl. No.: 15/144,329

(22) Filed: May 2, 2016

(65) Prior Publication Data

US 2017/0314351 A1 Nov. 2, 2017

(51) Int. Cl.
*E21B 19/16* (2006.01)
*E21B 19/087* (2006.01)

(52) U.S. Cl.
CPC ..... *E21B 19/164* (2013.01); *E21B 19/087* (2013.01); *E21B 19/16* (2013.01); *E21B 19/163* (2013.01); *E21B 19/167* (2013.01)

(58) Field of Classification Search
CPC ..... E21B 19/16; E21B 19/166; E21B 19/167; E21B 19/00; E21B 19/164; E21B 19/087; E21B 19/15
See application file for complete search history.

(56) References Cited

U.S. PATENT DOCUMENTS

| | | | | |
|---|---|---|---|---|
| 2,295,720 | A * | 9/1942 | Dietzmann | E21B 19/16 166/77.51 |
| 3,144,794 | A * | 8/1964 | Foster | E21B 19/167 81/383.5 |
| 4,290,494 | A | 9/1981 | Blanz | |
| 6,158,516 | A | 12/2000 | Smith et al. | |
| 6,212,763 | B1 * | 4/2001 | Newman | B25B 21/002 173/180 |
| 6,374,706 | B1 * | 4/2002 | Newman | E21B 19/166 81/57.16 |
| 9,097,064 | B2 | 8/2015 | Flusche | |
| 9,194,194 | B2 | 11/2015 | Flusche | |
| 9,238,947 | B2 | 1/2016 | Kallal | |
| 9,260,929 | B2 | 2/2016 | Mark | |
| 9,267,328 | B2 | 2/2016 | Flusche | |
| 9,273,523 | B2 | 3/2016 | McIntosh et al. | |
| 2008/0185154 | A1 * | 8/2008 | Holladay | E21B 19/167 166/377 |
| 2009/0038789 | A1 * | 2/2009 | Carstensen | E21B 19/164 166/77.51 |

* cited by examiner

*Primary Examiner* — Yong-Suk Ro
(74) *Attorney, Agent, or Firm* — Dentons US LLP

(57) ABSTRACT

A sucker rod tong assembly for fastening together sucker rods to a rod coupling, where the assembly can include a two-stage mechanical drive mechanism. The first stage can connect an upper sucker rod to a lower sucker rod via a rod coupling. The first stage can be limited in mechanical ability to tighten the connection to a pre-set shoulder torque value. The second stage can then be hydraulically and mechanically sequenced, using a linear gear drive mechanism, to rotate a main tong pinion gear that can further rotate the sucker rod connection through a fixed circumferential displacement to a mechanical stop.

7 Claims, 10 Drawing Sheets

CIRCUMFERENTIAL DISPLACEMENT SUCKER ROD TONG

TECHNICAL FIELD

The present disclosure relates to a tool commonly known as a sucker rod tong used for assembling and disassembling threaded sucker rods of oil wells, and more specifically pertains to a linear drive mechanism for the second stage tightening to a circumferential displacement of the sucker rods to a rod coupling.

BACKGROUND

Oilfield wells include the use of sucker rods consisting of 25 to 30 foot lengths of solid rods with male threads at each end, threaded together into a rod string that connect the downhole oil well pump to the surface reciprocating drive that in its entirety brings liquid hydrocarbons from deep within the ground to the surface.

Each sucker rod threaded male end is screwed into a rod coupling or collar or box so that the shoulder of each rod end is tightened against the shoulder of the rod coupling. The connected and tightened assembly of sucker rod connected to a rod coupling which is connected to the next sucker rod forms the rod string.

The tightening of each sucker rod threaded connection to a specific circumferential displacement from a hand tight shouldered circumferential position is the method determined by the sucker rod manufacturers to achieve the correct tightness between the sucker rod and the sucker rod collar. Inaccurate tightness of a connection can cause failure of the sucker rod string within the well bore.

Hundreds of sucker rod connections typically comprise a rod string in oil wells. Sucker rod connections are critical to the operational life of a sucker rod string.

Currently hydraulically powered sucker rod tongs are commonly used to assemble and disassemble a string of sucker rods. Current practices involve screwing the sucker rod connections together manually or with hydraulic powered sucker rod tongs to the shoulder of the connection and then without stopping the sucker rod tongs, they apply rotational torque between the upper and lower sucker rod connections using the hydraulically powered sucker rod tong and engage the upper and lower sucker rod segments on their respective mating rod flats to the rod coupling. The rod coupling provides the connection between sucker rods. Activating the hydraulically powered sucker rod tongs rotates one sucker rod thread relative to the other sucker rod thread to achieve a tight connection. As the connection tightens, the tong ultimately stalls at the hydraulic pressure preset by the operator assuming the achievement of a corresponding torque and circumferential displacement movement of the sucker rod connections relative to each other. When the tong rotationally stalls, the operator assumes that the connection has achieved the predetermined circumferential displacement position and is properly torqued.

The position at which the rod connections displace from the hand tightened shouldered circumferential position is not predictable. Frequently, the operator tests the position at which the force of the hydraulically powered sucker rod tongs tightens the connection to and the operator measures that distance in comparison to a known circumferential displacement scale or CD Card. The hydraulic pressure setting of the hydraulic circuit is adjusted to approach the displacement result desired. This is an inaccurate, unreliable and unpredictable method of achieving a circumferential displacement from a known position. Repeatability of hydraulic relief valves is dependent on oil flow, viscosity and fluid pressure drops. Variations within the relief valves ability to repeat this setting can exceed 10%. The hydraulic motor that delivers the torque to the hydraulically powered tong assembly within its design can vary its output torque given the same input hydraulic pressure throughout 1 revolution of the motor. The motor can have as few as 5 power strokes per revolution and output torque can exceed ±20% specifically due to the rotational position that the motor is in as torque is being applied to the sucker rod connections. The force which is required to rotate different sucker rods and couplings can vary significantly resulting in significant differences in final circumferential displacement. The result of the current sucker rod hydraulic powered tongs design is that circumferential displacement of the sucker rod connection from a hand tightened shoulder circumferential position is not predictable or reliable.

It is, therefore, desirable to provide a sucker rod tong that can tighten sucker rod connections to an accurate, repeatable and reliable circumferential displacement from a shoulder position.

SUMMARY

In some embodiments, a sucker rod tong can be provided that can consistently achieve a shoulder point of a sucker rod connection by the mechanical and hydraulic force limitations of the first stage of the CD tong drive. In some embodiments, a sucker rod tong can be provided with the ability to circumferentially displace the sucker rod connection to a position that can be a physical, mechanical and adjustable stop achieved by a linear actuator in one continuous movement.

In some embodiments, a hydraulically powered sucker rod tong can be provided (hereinafter referred to as a CD tong) that can, in its first stage of movement, limit the tightening of the sucker rod connection positively in its achievement to a hand-tight, shouldered circumferential position.

In some embodiments, the CD tong can comprise a linear-geared rack and pinion to provide the second stage of movement drive integrated with the first stage main drive gear of the CD tong that can, following achievement of a shouldered connection sequentially, move the main gear of the CD tong to a preset distance to a mechanical stop of the linear geared rack that is the circumferential displacement from the shouldered position of the sucker rod connection.

In some embodiments, the linear gear drive can circumferentially displace a sucker rod connection from a hydraulically generated hand tightened position to a specific set distance from that hand tightened position in one continuous movement. The mechanical set point for each size and grade of sucker rod connection can be manually adjusted, set and locked for a complete run of one size of sucker rods.

In some embodiments, a method can be provided to tighten two sucker rods into a sucker rod connector after reaching the point of hand tightness, said method can comprise the step of actuating a linear gear drive to move to a predetermined position, wherein the linear drive gear can be in operational connection with sucker rod tongs, and wherein the movement of the linear drive gear can actuate a circumferential rotational movement of the sucker rod tongs to a pre-determined position.

In some embodiments a use of a linear gear drive in a sucker rod tong assembly used in oil wells can be provided, wherein the linear gear drive can be operatively connected to a sucker rod tong adapted to tighten two sucker rods into a sucker rod connector from a hand-tight first position to a predetermined second position by rotating a first sucker rod. In some embodiments, the linear gear drive can comprise a rack and pinion. In other embodiments, several linear displacement drives can be adapted for use in the CD tong assembly.

In some embodiments, a sucker rod tong assembly can be provided comprising a linear drive mechanism adapted to tighten a sucker rod to a rod connector from a first hand-tight position to a second predetermined position, wherein the linear drive mechanism can be operatively connected to the sucker rod tong such that positive movement of the linear drive mechanism can actuate rotational movement of the sucker rod tong to tighten a sucker rod into a sucker rod connector.

In some embodiments, a device for use in the tightening of two sucker rods into a rod coupling can be provided, wherein the device can comprise a first stage tightening mechanism and a second stage tightening mechanism, where the second stage tightening mechanism can be a linear drive mechanism operatively connected to a sucker rod tong and adapted to move the sucker rod tong from a first position circumferential position to a second predetermined circumferential position.

In some embodiments, the sucker rod tong assembly does not require the use of electrical instrumentation; rather, it can effect a positive displacement using mechanical circumferential displacement movement only.

DETAILED DESCRIPTION OF EMBODIMENTS

Figure 1:
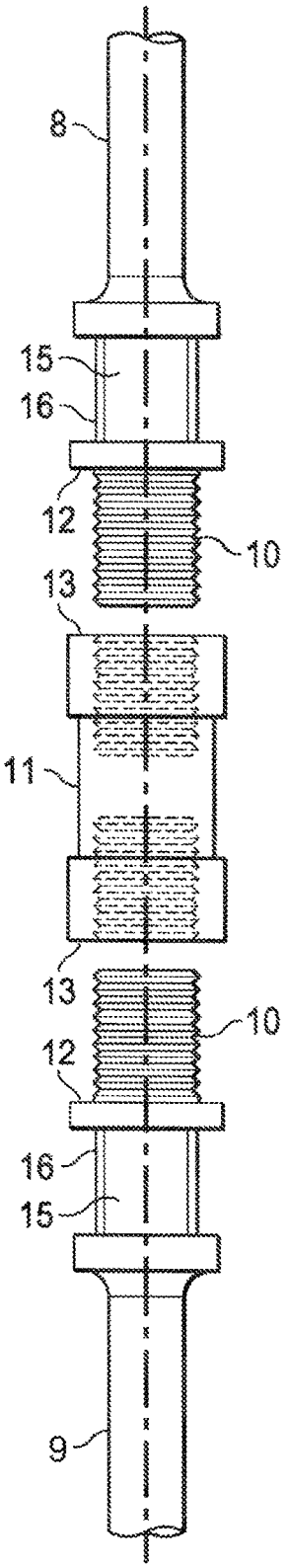
FIG. 1 is an exploded side elevation view depicting two sucker rods and a rod coupling, the rod coupling shown in cross section.

Referring to FIG. 1, upper sucker rod (8) and lower sucker rod (9) can each include threaded pin (10) that screws into coupling (11). Shoulder (12) of upper sucker rod (8) and lower sucker rod (9) can be machined to bear against axial face (13) of coupling (11). Upper sucker rod (8) and lower sucker rod (9) can be provided with a set of wrench flats (15) suitable to be engaged by sucker rod CD tong assembly (14) used for screwing together and tightening the sucker rods.

Figure 2:
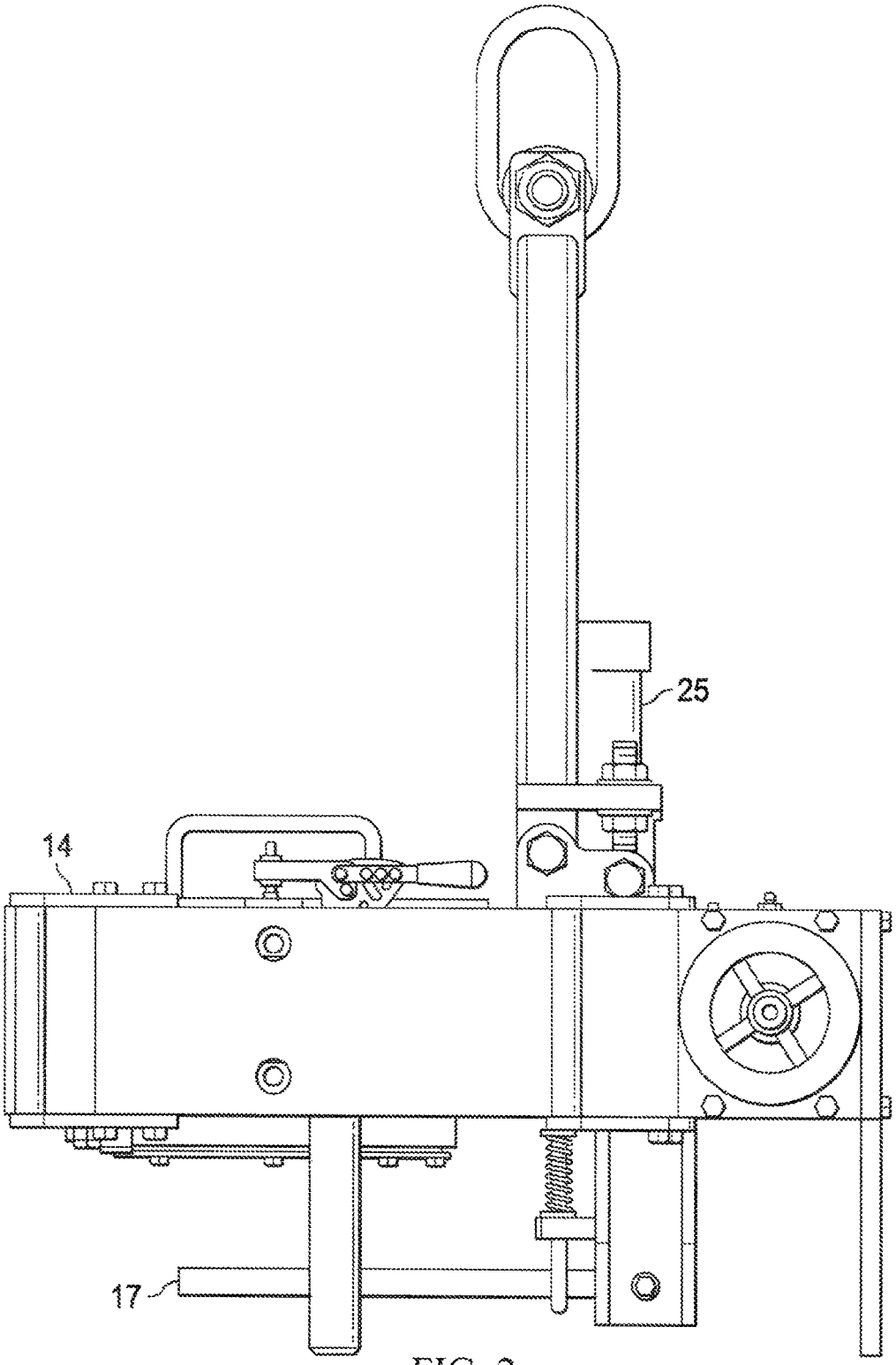
FIG. 2 is a side elevation view depicting one embodiment of a CD tong assembly and a lower sucker rod (9) with rod coupling engaged with the lower back up wrench of the CD tong assembly.

Referring to FIG. 2, CD tong assembly (14) and lower sucker rod (9) with rod coupling (11) is shown engaged with lower back up wrench (17) of the CD tong assembly (14). To tighten the threaded connection between upper sucker rod (8) and lower sucker rod (9) to a required circumferential displacement, CD tong assembly (14) can first be maneuvered to engage with mating rod flats (15) of upper sucker rod (8) and lower sucker rod (9) on either side of rod coupling (11). Then, CD tong assembly (14) can be activated to rotate the connecting threads of upper sucker rod (8) and lower sucker rod (9) into rod coupling (11) to a hand tight, shoulder circumferential start position. In some embodiments, CD tong assembly's (14) first gear hydraulic motor drive stage (25) does not have the mechanical ability to exceed the rotational forces required to exceed a hand tight connection between upper sucker rod (8) and lower sucker rod (9) and the rod coupling. Once the rotational force is achieved to a hand tight shouldered position of the sucker rod connection, a hydraulic sequence valve can automatically shift and engage second gear hydraulic cylinder linear drive stage (30) of CD tong assembly (14), which can comprise linear hydraulic cylinder (31) driven rack (32) and pinion gear assembly (33). Hydraulic cylinder driven rack (32) can then extend, rotating pinion gear assembly (33) until hydraulic cylinder driven rack (32) stops against mechanical stop (34) that can be adjusted to an exact position that is the circumferential displacement from the hand tight shouldered position for the size and grade of sucker rod of the assembly.

Referring to FIGS. 5 to 10, in some embodiments, CD tong assembly (14) can comprise rotational upper jaw (1) to engage flats (15) of upper sucker rod (8) and backup wrench (17) for engaging flats (15) of lower sucker rod (9). In some embodiments, upper jaw (1) can comprise one gripper (19) pivotally attached to gear segment (20) and outer geared ring assembly (22) by way of pins (21). Pins (21) can allow gripper (19) to pivot in and out of engagement with flats (15) of upper sucker rod (8), while gear segment (22) can render upper jaw assembly (1) rotationally relative to CD tong housing (23).

Figure 3:
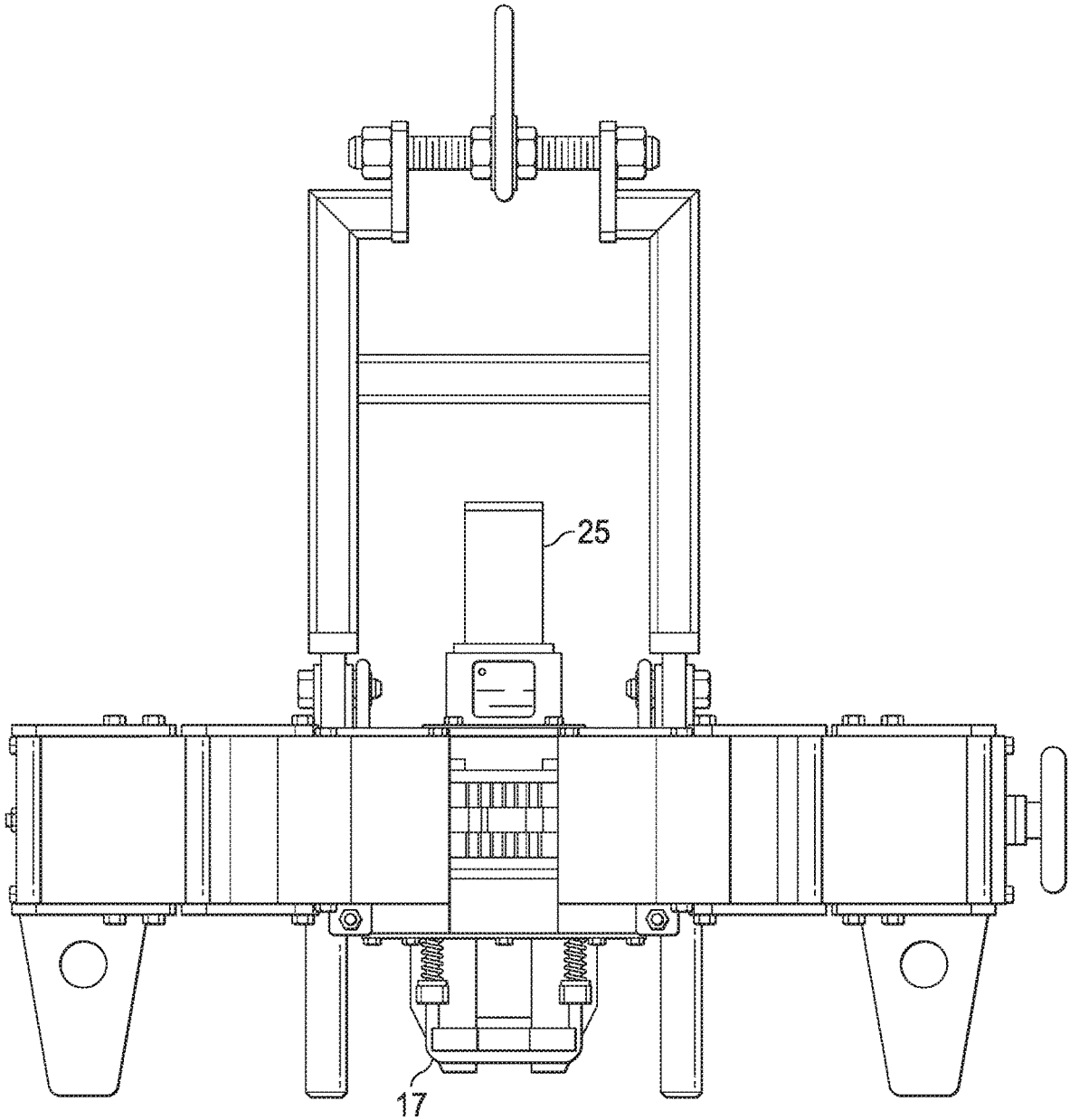
FIG. 3 is a front elevation view depicting the CD tong assembly of FIG. 2.

FIG. 2 shows backup wrench (17) of CD tong assembly (14) engaged from lower sucker rod (9). FIG. 3 shows CD tong assembly (14) disengaged from the sucker rods.

Figure 4:
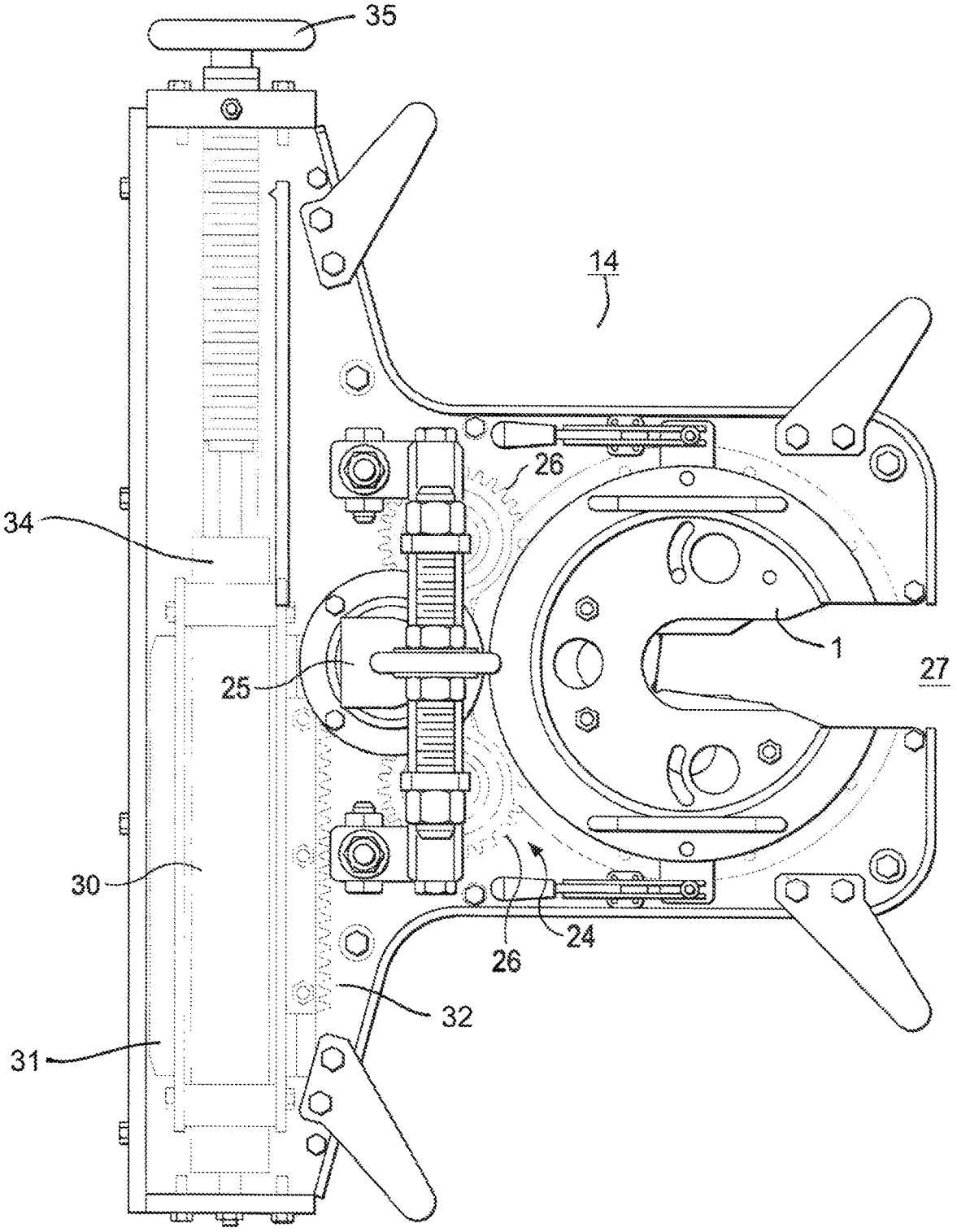
FIG. 4 is a bottom plan view depicting the CD tong assembly of FIG. 2 in cross-section view and the hydraulic cylinder rack gear disengaged from the pinion gear.
Figure 5:
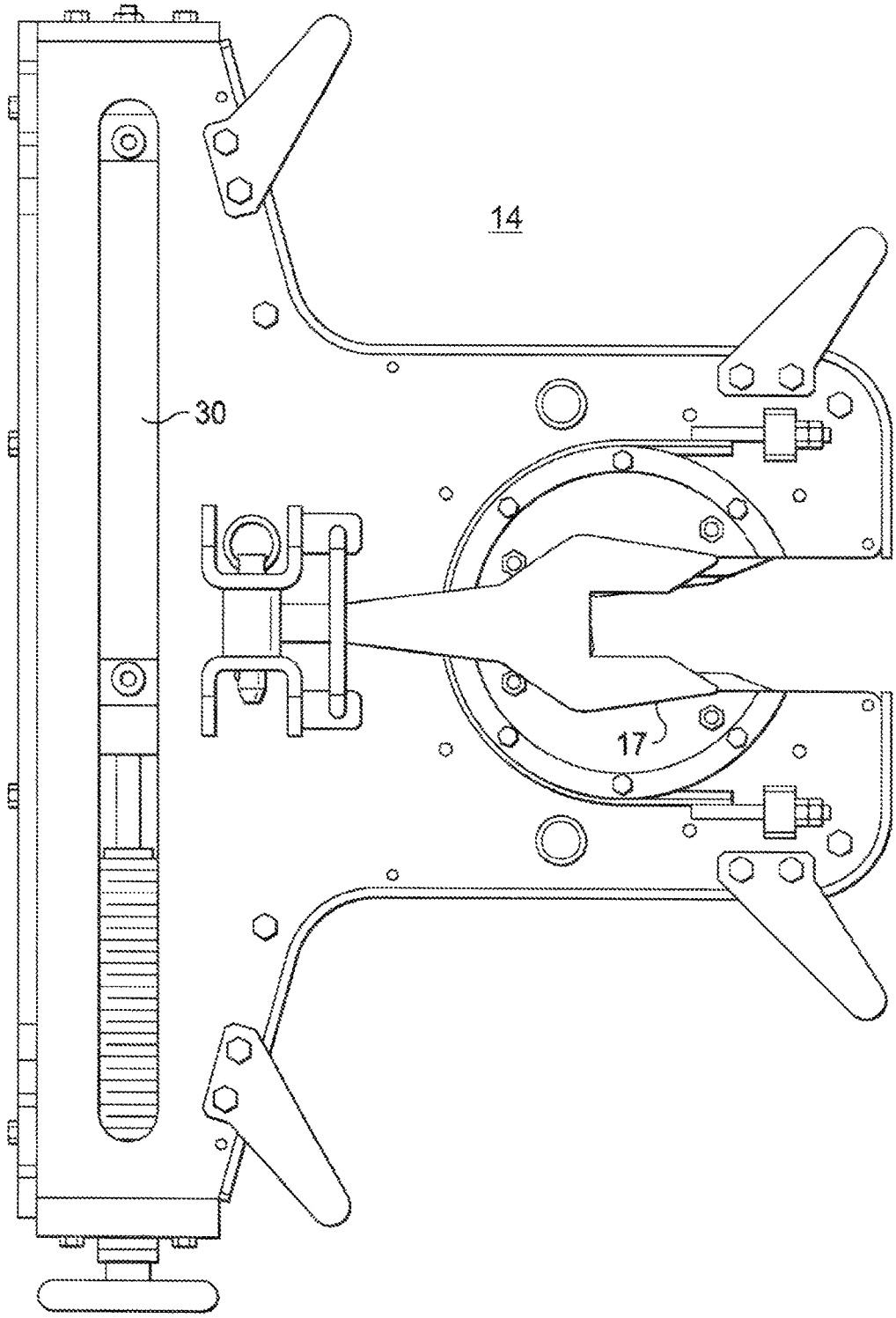
FIG. 5 is a bottom plan view depicting the CD tong assembly of FIG. 2 with the backup wrench engaged with the lower sucker rod shown in cross section.
Figure 6:
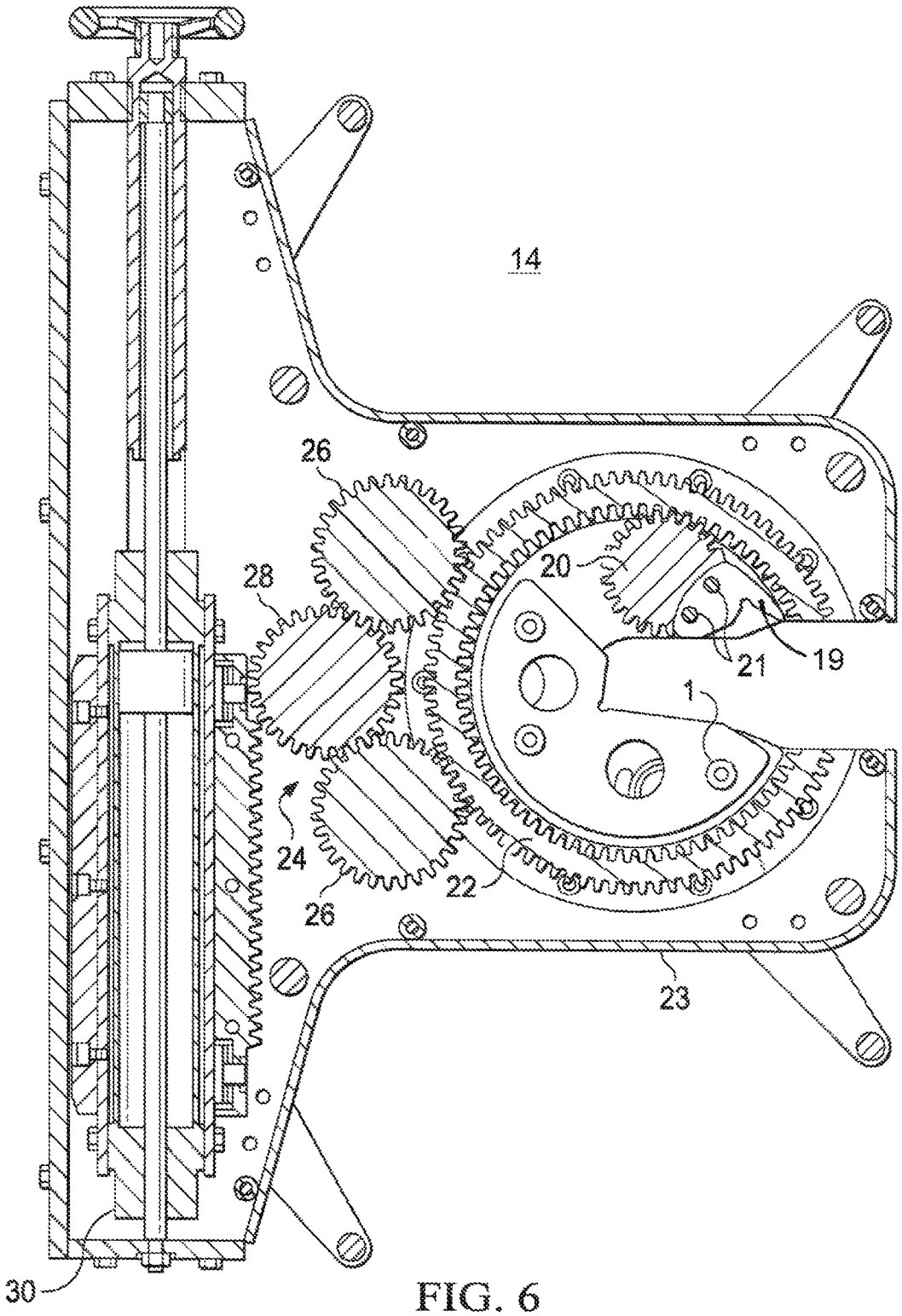
FIG. 6 is a top cross-sectional place view depicting the CD tong of FIG. 2 engaged with upper sucker rod connection in relation to the lower sucker rod connection.
Figure 7:
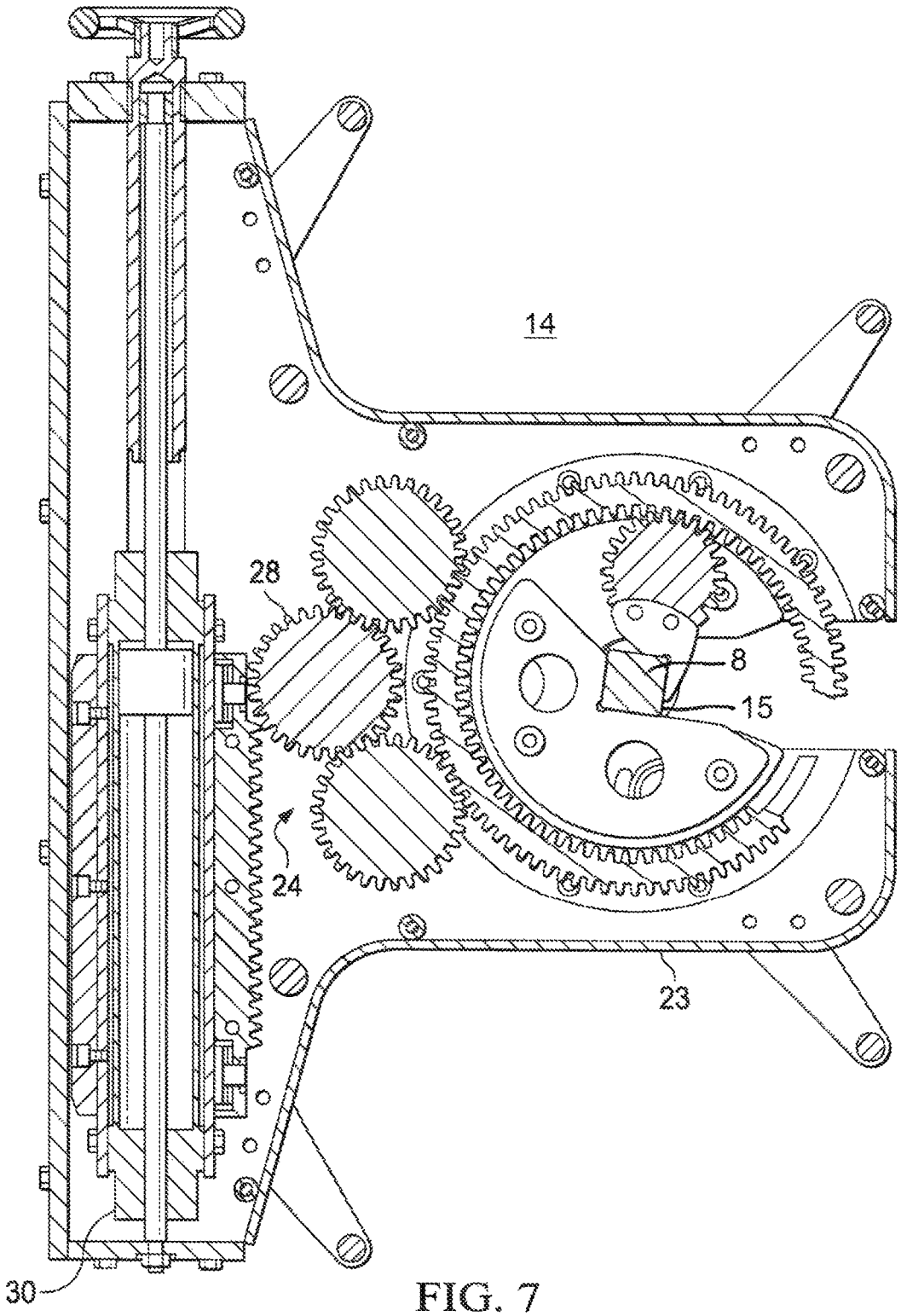
FIG. 7 is a top cross-sectional plan view depicting the CD tong assembly of FIG. 2, wherein the tong is engaged and rotating the upper sucker rod connection in relation to the lower sucker rod connection to shoulder without the hydraulic cylinder rack gear engaged with the CD tong pinion gear.
Figure 8:
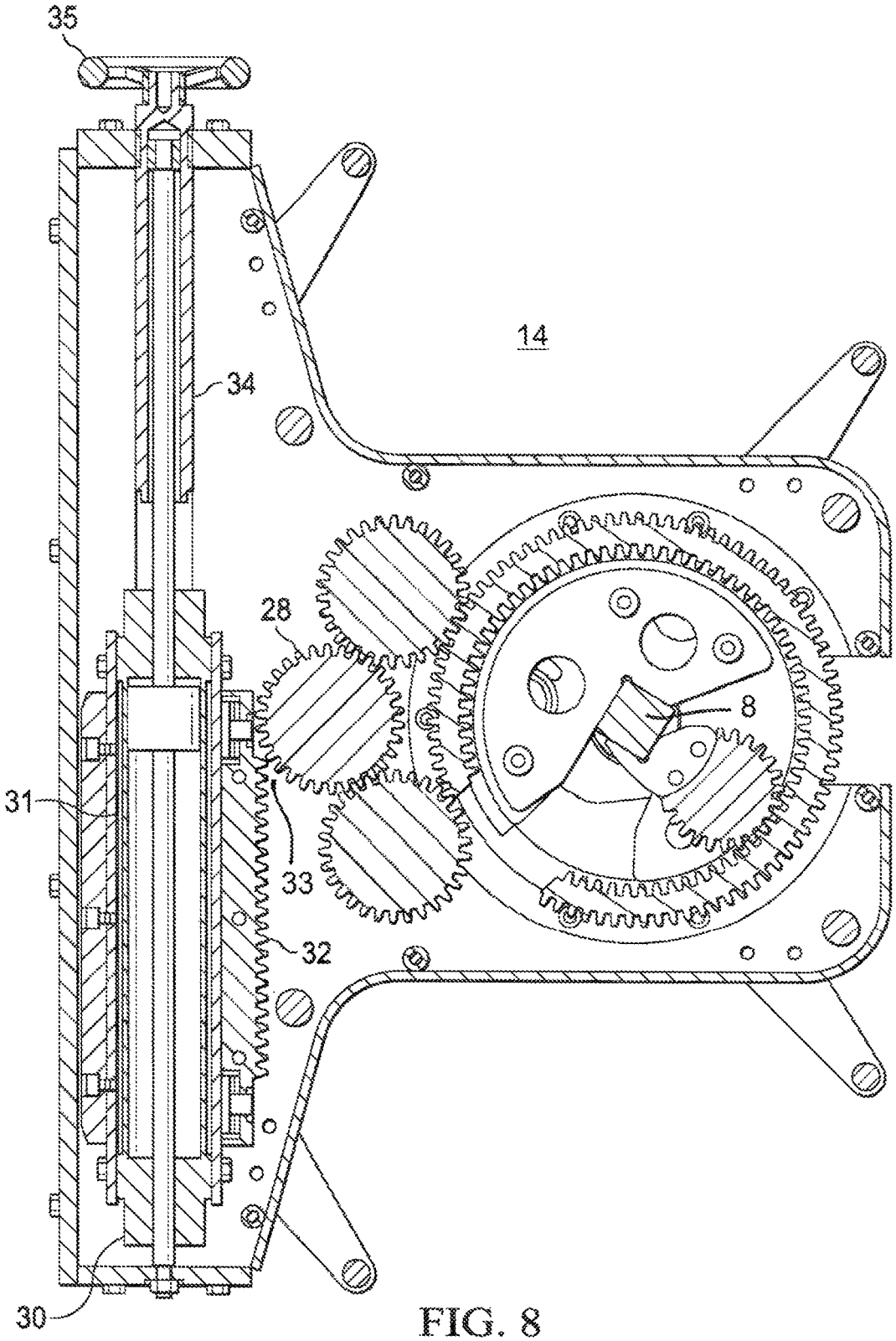
FIG. 8 is a top cross-sectional plan view depicting the CD tong assembly of FIG. 2, wherein the tong is engaged and in rotational movement driven by the hydraulic cylinder rack gear as it is engaged with the pinion gear to a mechanical stop set and locked with a hand wheel or other mechanical adjustment.
Figure 9:
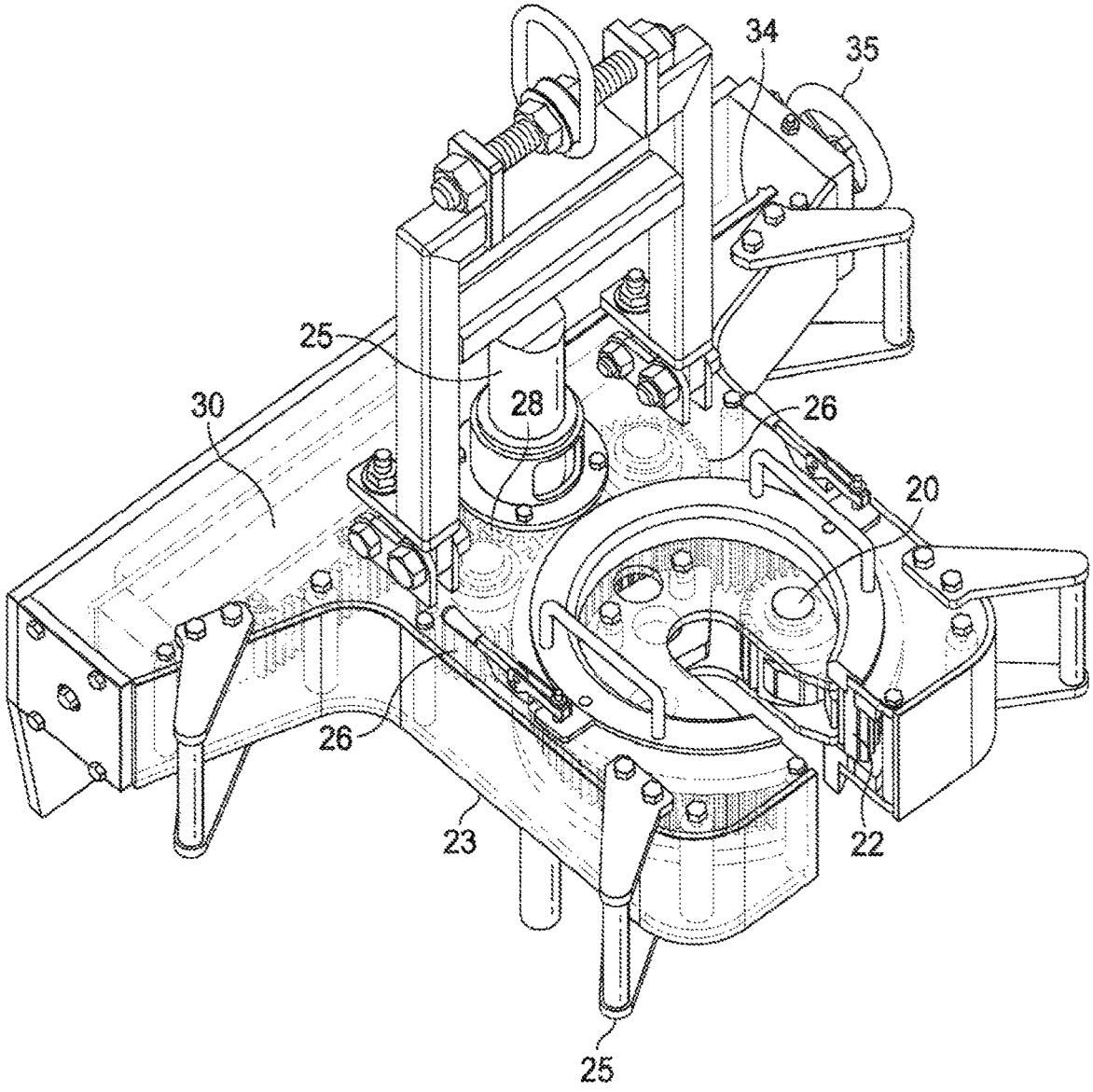
FIG. 9 is a top perspective transparent view depicting the CD tong assembly of FIG. 2 showing the inner workings of the assembly.
Figure 10:
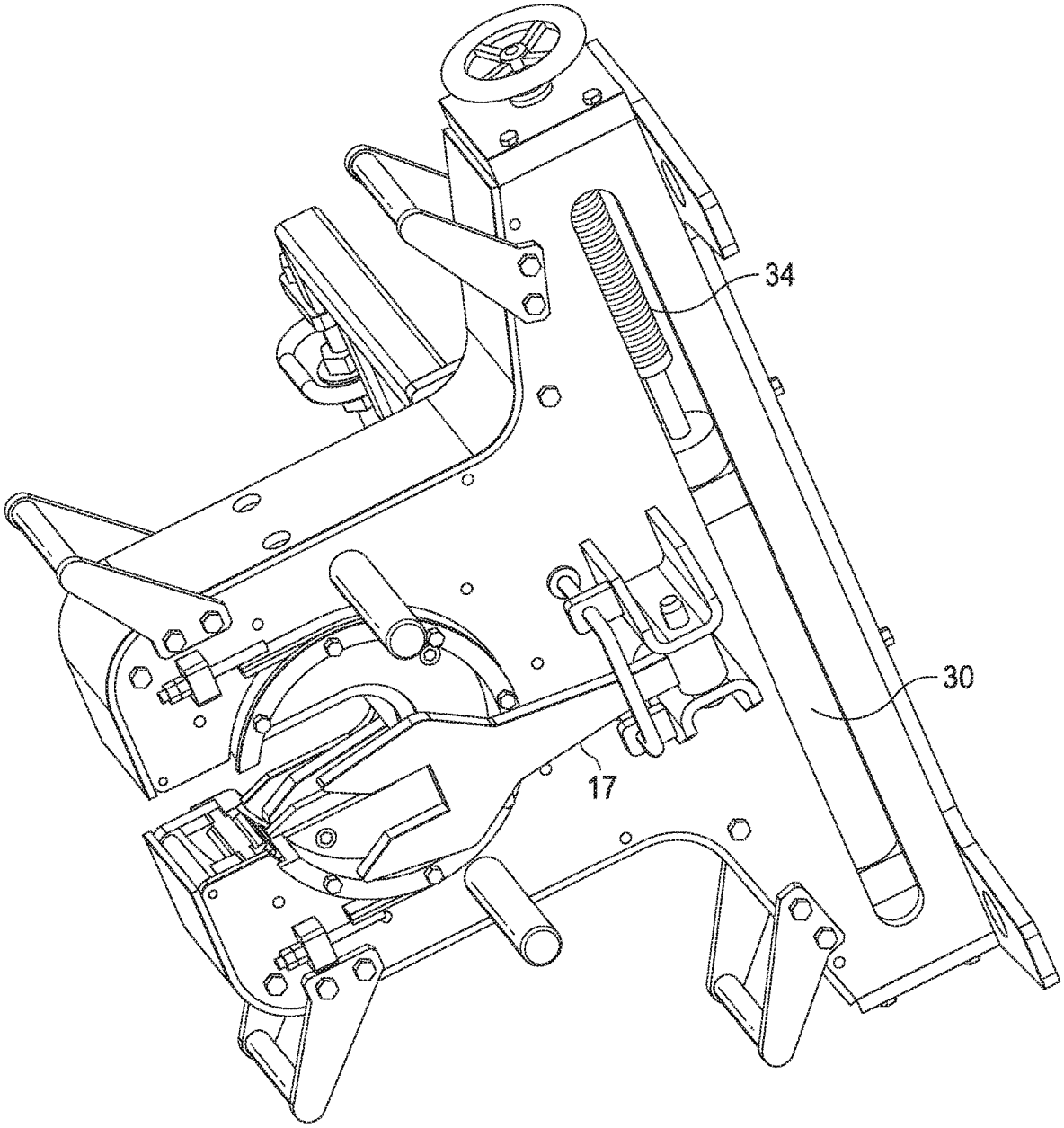
FIG. 10 is a bottom perspective view depicting the CD tong assembly of FIG. 2.

FIG. 4 shows a cross sectional view of CD tong assembly (14) and illustrates gear drive train (24) that can couple hydraulic motor (25) to upper jaw (1). In some embodiments, gear drive train (24) can comprise two drive gears (26) so that at least one of them remains in driving contact with gear segment (22) at all times, as gear segment (22) has a discontinuity or opening (27) for receiving and releasing upper sucker rod (8). In some embodiments, two drive gears (26) can reduce drive speed from input pinion gear (28) to input segment gear (22). In some embodiments, hydraulic motor (25) can be coupled to and turn input pinion gear (28)

and rotate drive gear train (24) at a reduced speed to provide upper jaw (1) with sufficient torque to be able to screw sucker rods (8) and (9) into coupling (11) to a hand tighten shoulder torque. To disassemble or unscrew at least one sucker rod (8) or (9) from coupling (11), the rotational direction of motor (25) can be reversed.

In some embodiments, when the hydraulic pressure within the hydraulic system powering hydraulic motor (25) achieves a set fixed hydraulic pressure, a hydraulic pressure sequence valve can be activated directing hydraulic oil to hydraulic cylinder (31) activating that hydraulic cylinder (31) to move geared rack (32) to mechanical threaded stop (34) ensuring that the rod connection has achieved circumferential displacement from the hand tightened shoulder position of the connection.

CD tong assembly (14) geared rack (32) driven hydraulically by hydraulic cylinder (31) can engage with pinion gear (28) to displace the connection between upper sucker rod (8) and lower sucker rod (9) from a hand tight shouldered torque to a circumferential displacement from the shoulder tight position of the connection. The distance that the geared rack moves can correspond to an accurate circumferential displacement of the connection from the hand tight shouldered torque and can be determined by mechanical threaded stop (34) that can be adjusted manually and set by hand wheel (35). It is unique that the circumferential displacement of the connection can be determined by a fixed distance traveled to a mechanical stop by hydraulic cylinder (31) powered geared rack (32).

In some embodiments, once the connection between upper sucker rod (8) is circumferentially displaced by a predetermined distance relative to lower sucker rod (9), the linear gear drive can stop moving.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

We claim:

1. A sucker rod tong assembly for tightening a sucker rod to a sucker rod connector, the assembly comprising: a linear drive mechanism adapted to tighten the sucker rod to the sucker rod connector from a hand-tight shouldered position to a circumferential displacement from the hand-tight shouldered position whereby the sucker rod is tightened to the sucker rod connector, wherein the linear drive mechanism is operatively connected to a rotating pinion gear assembly configured to rotate a sucker rod tong to tighten the sucker rod to the sucker rod connector when the linear drive mechanism is operated.

2. The sucker rod tong assembly as set forth in claim 1, wherein the linear drive mechanism comprises:

a) a linear hydraulic cylinder configured to extend;

b) a rack operatively coupled to the linear hydraulic cylinder, wherein the rack is driven when the linear hydraulic cylinder extends; and c) a mechanical stop configured to limit the distance the linear hydraulic cylinder can extend.

3. The sucker rod tong assembly as set forth in claim 2, wherein the hydraulic cylinder driven rack is operatively coupled to the rotating pinion gear assembly, wherein the rotating pinion gear assembly rotates the sucker rod tong when the rack is driven.

4. The sucker rod tong assembly as set forth in claim 2, wherein the mechanical stop comprises a mechanical threaded stop configured for manual adjustment to set the distance the linear hydraulic cylinder extends.

5. The sucker rod tong assembly as set forth in claim 1, wherein the sucker rod tong comprises:

a) an upper jaw operatively coupled to the rotating pinion gear assembly, the upper jaw configured toto engage first flats disposed on the sucker rod; and b) a backup wrench, the backup wrench configured to engage second flats disposed on the sucker rod connector.

6. The sucker rod tong assembly as set forth in claim 5, wherein the upper jaw further comprises a gripper pivotally attached thereto, the gripper configured to pivotally engage the first flats of the sucker rod when the upper jaw is rotated to tighten the sucker rod to the sucker rod connector.

7. The sucker rod tong assembly as set forth in claim 1, further comprising a first gear hydraulic motor drive stage configured to tighten the sucker rod to the sucker rod connector to the hand-tight shouldered position.

* * * * *